US005103215A

United States Patent [19]

Taylor et al.

[11] Patent Number: 5,103,215

[45] Date of Patent: Apr. 7, 1992

[54] DEVICE FOR SIGNALLING STATUS OF MACHINES OR PROCESSES

[75] Inventors: James Taylor, Chicago; Sarosh Khambatta, Orland Park; Moti Thadani, Hillside, all of Ill.

[73] Assignee: Federal Signal Corporation, Oak Brook, Ill.

[21] Appl. No.: 595,209

[22] Filed: Oct. 10, 1990

[51] Int. Cl.[5] ..... G08B 3/00

[52] U.S. Cl. ..... 340/691; 340/679; 340/525; 340/815.23

[58] Field of Search ..... 362/219, 237; 340/332, 340/331, 815.15, 815.16, 815.17, 815.18, 679, 691, 524, 286.11, 525, 815.23

[56] References Cited

U.S. PATENT DOCUMENTS

| | | | |
|---|---|---|---|
| 3,299,264 | 1/1967 | Lipscomb | 362/219 |
| 3,555,543 | 12/1967 | Lynch | 340/815.18 |
| 3,818,439 | 6/1974 | Maine | 340/331 |
| 3,873,885 | 3/1975 | Elfverson . | |
| 3,924,255 | 12/1975 | Mori | 340/679 |
| 4,017,831 | 4/1977 | Tieden | 340/825.17 |
| 4,364,105 | 12/1982 | McNamara, Jr. | 362/237 |
| 4,399,434 | 8/1983 | Bielat . | |
| 4,668,935 | 5/1987 | McDermott | 340/332 |

OTHER PUBLICATIONS

Telemechanique catalog.
The "Luminous Tower".
Sasaki Electric Manufacturing Company catalog.
The Asahi catalog.
The Werma catalog.

*Primary Examiner*—Jin F. Ng
*Assistant Examiner*—C. Oda
*Attorney, Agent, or Firm*—Leydig, Voit & Mayer

[57] ABSTRACT

A signalling device is provided having a plurality of differently colored light modules stacked one above the other than function properly regardless of arrangement order of the light modules within the signalling device. The signalling device includes a signal bus having a plurality of channels that extends through each light module. Each channel carries a unique status signal to one light module. Each light module is connected to and identified by a different channel, thus enabling the light modules to be arranged in any order and still function properly. One or all cover plates on each light module may be removed without requiring any light module to be removed from the signalling device. This feature enables both the light modules to be serviced while retaining their color identity and the color of the cover plates to be changed without requiring any light modules to be removed from the signalling device in either situation. The signalling device is quickly assembled with dilating rivets. A data logger connected to each signalling device records the changing status as indicated by each light module. All these features enable the signalling device to be quickly and efficiently assembled and maintained.

24 Claims, 7 Drawing Sheets

DEVICE FOR SIGNALLING STATUS OF MACHINES OR PROCESSES

FIELD OF THE INVENTION

The present invention relates generally to signaling devices for indicating the operating status of machinery or processes and, more particularly, to such signaling devices that are elevated in order to enhance their visibility.

BACKGROUND OF THE INVENTION

Elevated signaling devices are well-known in factory-type environments where numerous industrial machines are present. Generally, such signaling devices are mounted on a pole so they are high above each machine and clearly visible from a distance. Each device typically has a plurality of differently colored lights for visually signaling the operating status of each machine.

In a typical signaling device, each of the lights is responsive to an operating status of the machine to which the device is connected. For example, a typical device may have five lights colored clear, blue, red, amber and green. An illuminated clear light may indicate that it is time to change a component on the machine, while an illuminated green light may indicate the machine is operating in cycle. The relative positioning of the lights is usually insignificant because someone monitoring the device is usually too far away to distinguish the positions of the lights. The colors of the lights are very important, however, because even at a distance an illuminated light of one color is immediately distinguishable from the other lights of different colors.

Elevated signaling devices are particularly effective in environments where the level of background noise is very high and there is a danger that an audible alarm will not be heard. Furthermore, the elevated signaling devices can distinguish between various malfunctioning conditions by relating different conditions to different colors of lights or to different frequencies of flashing lights. In a crowded factory, a system of elevated signaling devices enables maintenance people to quickly locate and identify specific problems in a large number of operating machines. Such a system is extremely effective and efficient because it enables a single individual to monitor a large number of machines from a distance where the operating status of all the machines can be simultaneously observed.

While these elevated signaling devices have proven to be very effective, their maintenance can be difficult. For instance, the seemingly simple task of changing a burned out light bulb can become quite a challenge when it involves replacing a bulb in a device that is located at the end of a pole ten feet or more above the factory floor. Usually, maintenance personnel climb a ladder in order to reach the signaling device. Typically, the device must be disassembled in order to gain access to the burned out light bulb. In a typical signaling device, such disassembling is necessary because the device is comprised of a plurality of stacked light modules, each being a sealed unit once assembled.

As can be easily appreciated, disassembling the device while standing on a ladder far above the factory floor is quite a burdensome, unpleasant and sometimes dangerous task. Furthermore, while disassembling the stacked modules of the signaling device is in itself quite a job, the task presents an additional problem of reassembling the modules of the stack in their correct relative positions. While the relative positioning of each light module is not important to a monitoring person, the relative position of each light module in contemporary signaling devices is important for the proper functioning of the device. Therefore, the maintenance personnel must either remember the correct position of each light module or keep them in order as the stack is disassembled and re-assembled. Furthermore, since the interior of conventional light modules are non-accessible when assembled, an entire light module must be replaced, or at least removed, in order to change a lens or cover plate of the light module.

OBJECTS AND SUMMARY OF THE INVENTION

In view of the foregoing, it is a primary object of the present invention to provide a signaling device having a plurality of stacked light modules that function properly regardless of their relative positions in the stack.

An additional object of the present invention is to provide a signaling device having a plurality of stacked light modules that can be serviced without necessarily requiring the stack of modules to be disassembled.

It is also an object of the present invention to enable a service person to change the color of each module in the stack without requiring the signaling device to be disassembled or re-wired.

Another object of the present invention is to provide a signaling device comprising a plurality of stacked light modules that can be quickly and easily assembled or disassembled when necessary without the use of bolts or screws.

A further object of the present invention is to provide a signaling device of stacked modules that is able to create a permanent record of conditions indicated by the lights of the device.

To achieve the foregoing objects and others, the present invention contemplates a signaling device comprising a plurality of differently colored light modules stacked one above the other and having a communications bus comprising a plurality of channels that extends throughout the stack of light modules. Each light module is connected to and identified by a different one of the channels, thus enabling the light modules to be arranged in any order and still function properly. At least one cover plate on each of the light modules may be removed without requiring the light module to be removed from its stack. This feature enables both the interior of the light modules to be serviced and the color of the cover plates to be changed without requiring disassembly of the stack. In one embodiment, a conventional data logger is connected to the device for recording the changing status of the lights, which in turn is indicative of a status of the machine or process being monitored.

Other objects and advantages of the present invention will become apparent upon consideration of the following detailed description when taken in conjunction with the drawings.

BRIEF DESCRIPTION OF THE DRAWINGS

FIGS. 8*a*–8*e* are alternative wiring diagrams for a light module, assuming five (5) channels in the communications bus.

While the invention will be described in connection with a preferred embodiment, there is no intent to limit it to that embodiment. On the contrary, the intent is to cover all alternatives, modifications and equivalents included within the spirit and scope of the invention as defined by the appended claims.

DETAILED DESCRIPTION OF THE PREFERRED EMBODIMENT

Figure 1:
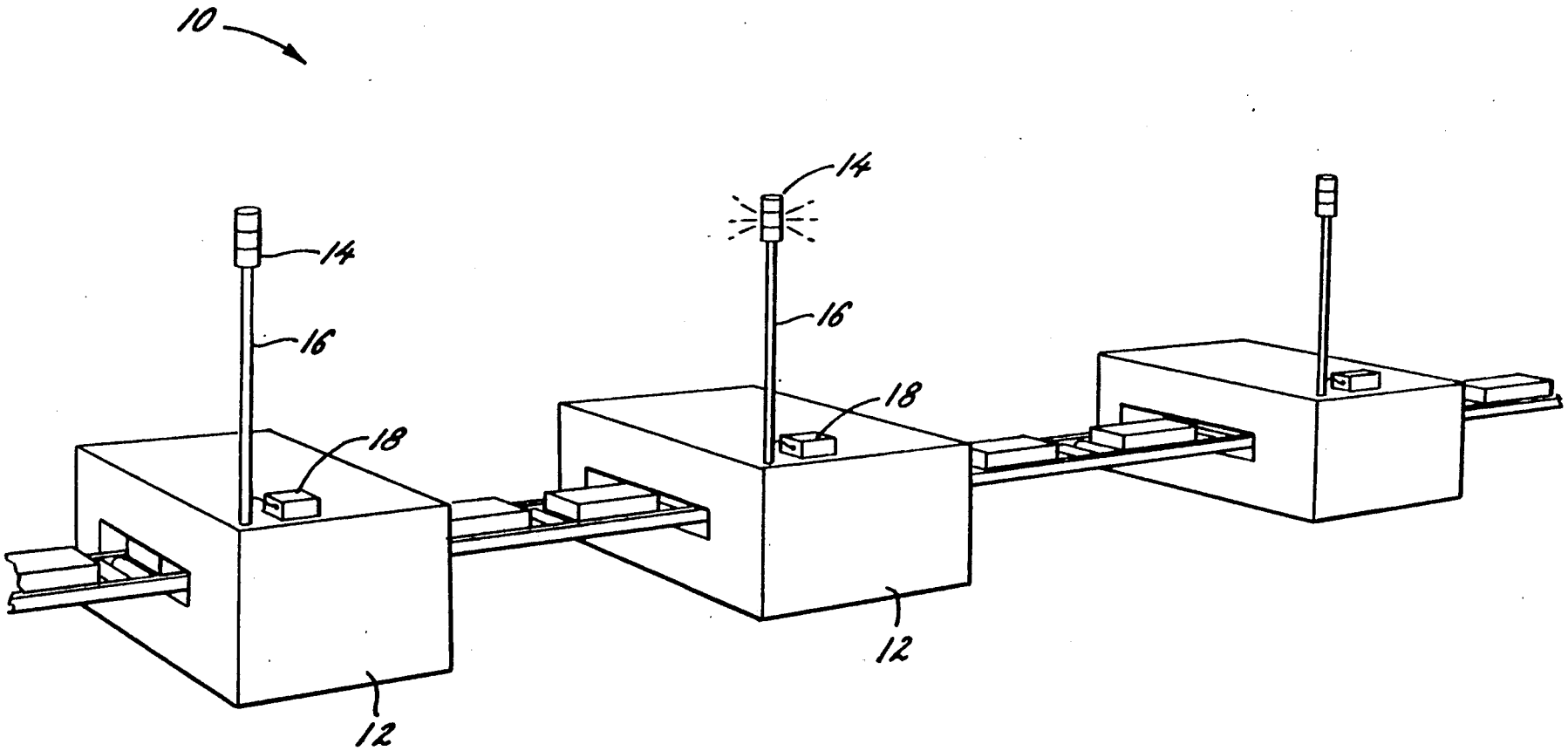
FIG. 1 is a perspective view of an exemplary assembly line utilizing a plurality of signaling devices in accordance with the present invention.

Turning to the drawings and referring first to FIG. 1, an exemplary environment for signaling device 14 of the invention includes an assembly line 10 having a plurality of machines 12 Each of the signaling devices 14 is associated with one of the machines 12 and is mounted atop a pole 16 high above the machine 12 so that the lights of the device are clearly visible at a distance. The pole 16 serves as means for supporting the signaling device 14 and also as a conduit for wiring between the machine 12 and the signaling device 14. A data logger 18 is connected to each signaling device 14 via wires in the pole !6. Each data logger is conventional and may, for example, be Model No. 740 by Keithley Scanning Co. As a complement to the visual signaling of the device, signals from the machines 12 may also activate audio alarms if desired.

Figure 2:
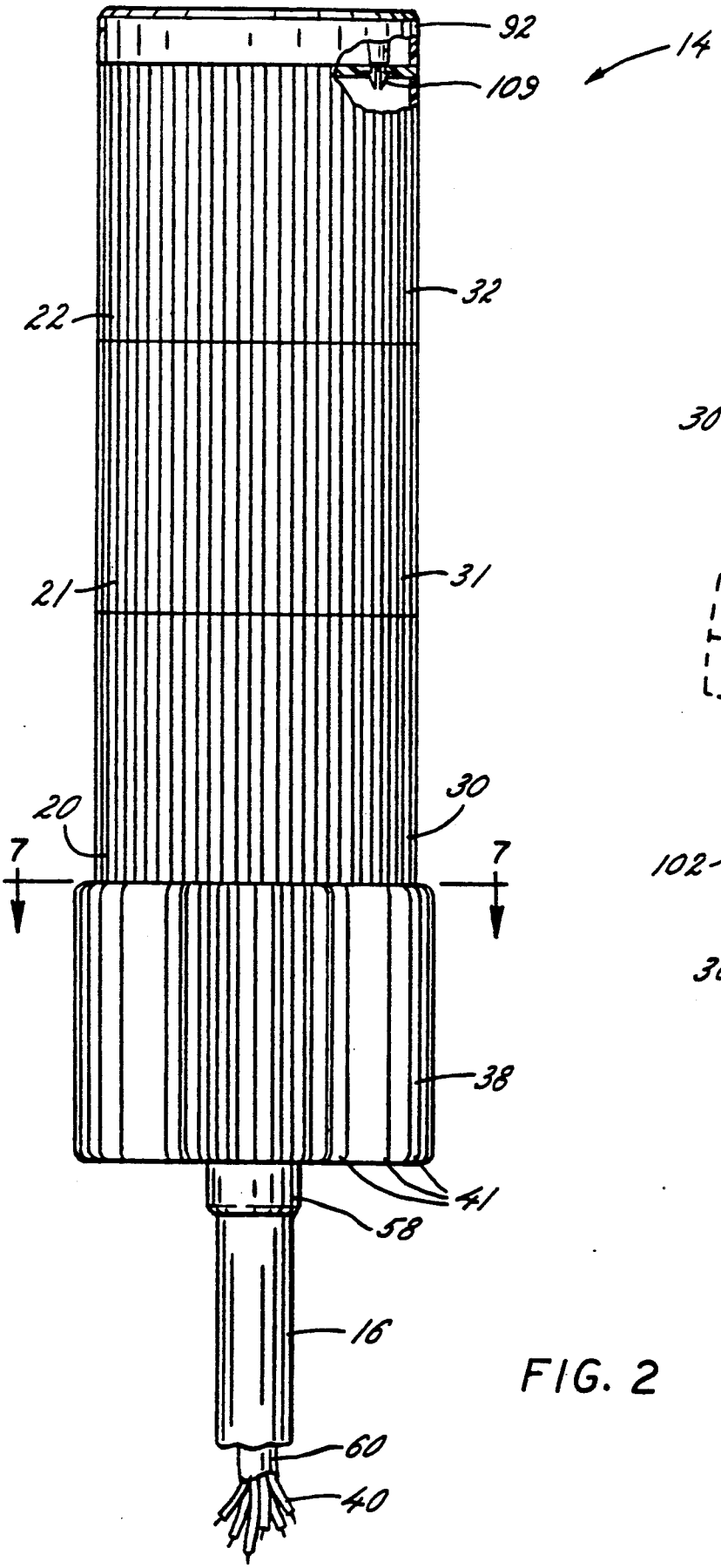
FIG. 2 is an enlarged, elevational view of one of the signaling devices shown in FIG. 1 and illustrating three light modules stacked one above another.

This illustrated signaling device 14 has three identical light modules 20–22 stacked end-to-end, one above the other, as shown in FIG. 2. Other embodiments may have a smaller or larger number of light modules. Moreover, the signaling device !4 may have other orientations than that illustrated, such as being stacked horizontally instead of vertically. Each light module 20–22 of the signaling device 14 has differently colored transparent cover plates or lens 30–32. The light modules 20–22 are preferably constructed of sturdy plastic, such as polycarbonate. However, other suitable materials may be used. The cover plates 30–32 are preferably fluted lens——i.e., lens having a horizontally rippled surface on the inside and a vertically rippled on the outside in order to disperse light waves produced by a light bulb 80 inside each of the light modules 20–22 so as to increase the visibility of the module.

A base member 38 mounts the light modules 20–22 to the pole 16 and also interlinks wiring 40 from the machine 12 to the modules. The base 38 is preferably made of a metal such as zinc and is formed by conventional casting processes.

Figure 7:
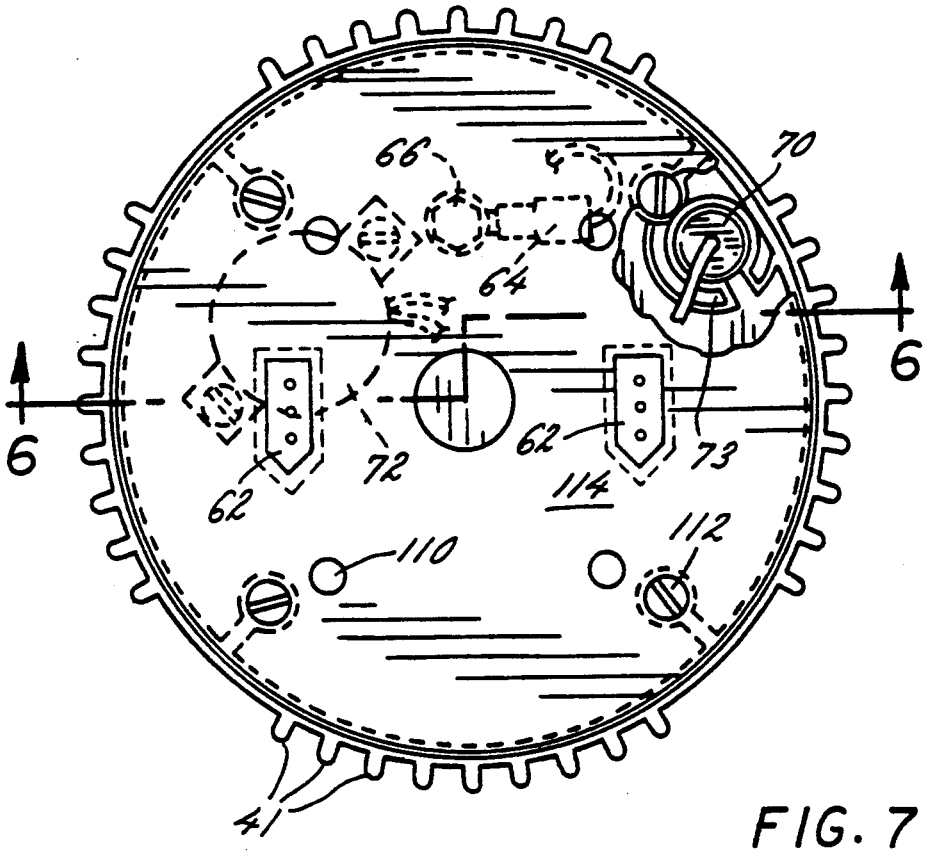
FIG. 7 is a top view of the base of the signaling device taken- along line 7—7 of FIG. 2.

The base 38 includes a plurality of external flanges 41 that collectively function as a heat sink to dissipate heat produced by a resistor 70 that reduces voltage supplied to the light modules 20–22 thus increasing bulb life. (See also FIG. 7.) The resistor 70 functions as a voltage reducing element, and therefore, other embodiments may replace the resistor 70 with another type of voltage reducing element such as a Sidac (made by Motorola) or other semiconductor. The resistor 70 is secured to the base 38 by a receptacle 73 that enables heat to be directly transferred to the flanges 41.

In accordance with one important aspect of the present invention, a signal bus having a plurality of channels extends through all of the light modules for the purpose of carrying signals to each of the modules. Each light module is responsive to the signals of one of the channels. Because the bus extends the length of the stacked modules, each module can be placed anywhere in the stack and, still function completely as intended.

Figure 3:
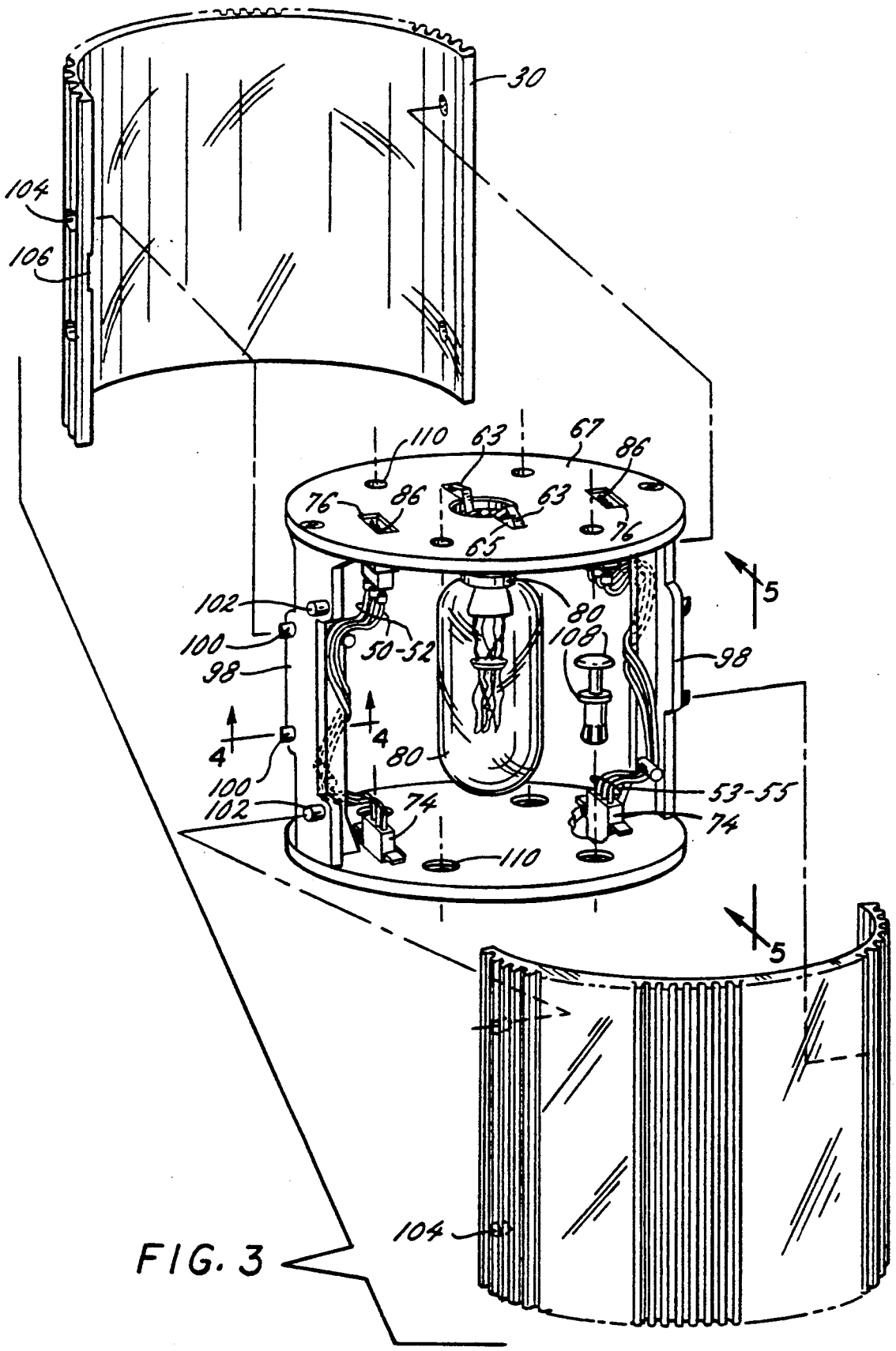
FIG. 3 is an exploded view of one of the light modules in the stack of modules illustrated in FIG. 2.
Figure 5:
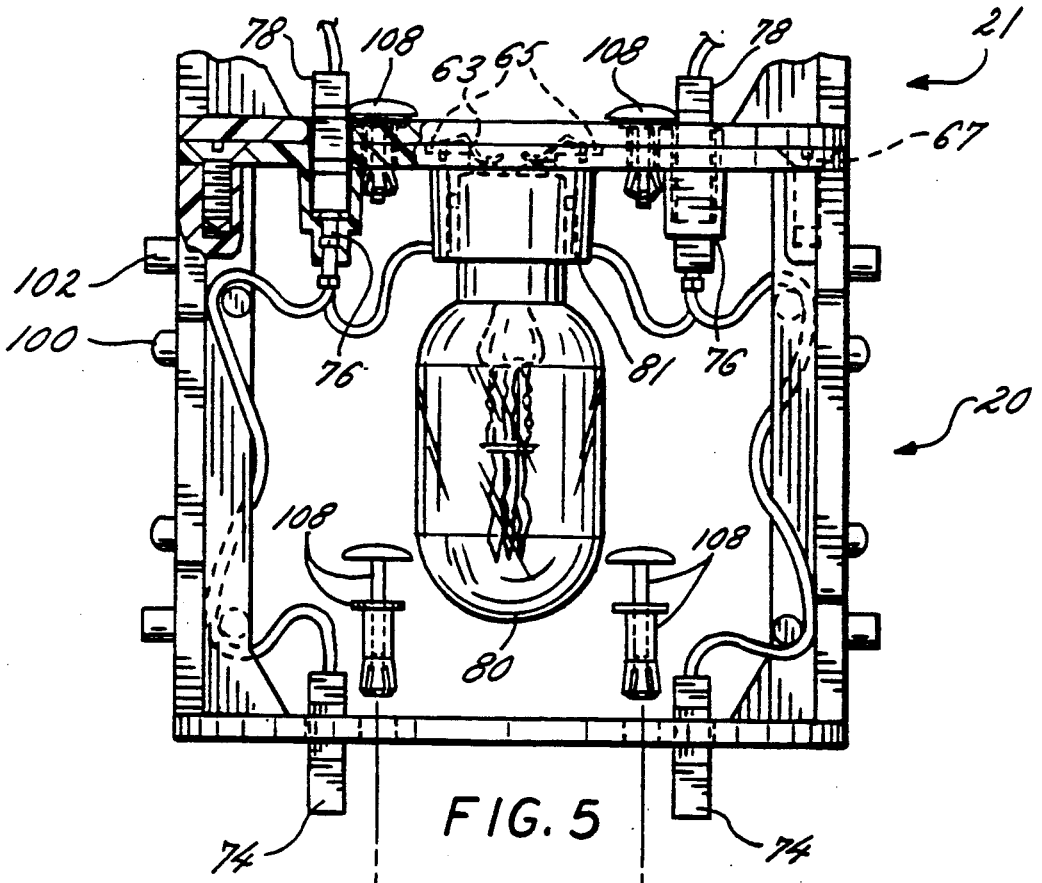
FIG. 5 is an elevational view of the light module in FIG. 3 taken along line 5—5, illustrating the module with its cover plates removed.
Figure 6:
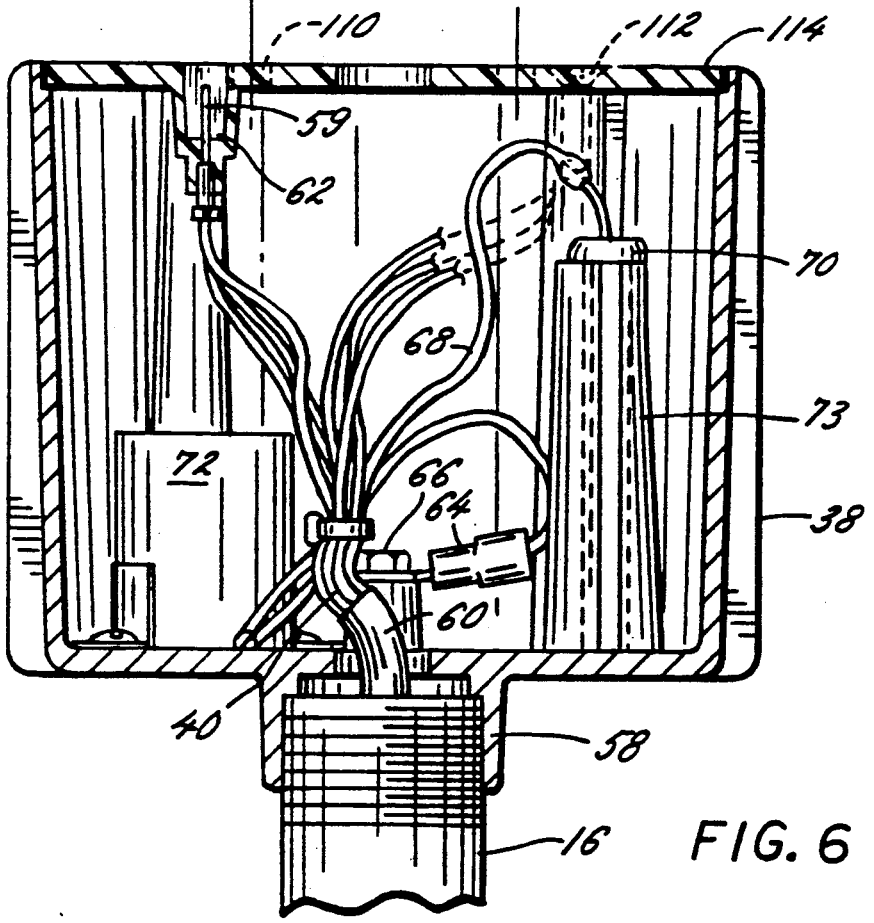
FIG. 6 is a cross-sectional view of a base for supporting the stack of light modules taken along line 6—6 of FIG. 7.

A path of the signal bus 42 extending through each of the light modules 20–24 (five modules numbered 20–24) may be followed by examining FIGS. 5 and 6. FIG. 6 is a cross-sectional view of the base 38 illustrating its internal wiring. The base 38 includes a threaded receptacle for receiving a threaded end of the pole 16. Inside the pole 16 is a cable 60 containing the plurality of wires 40 provided from the machine 12. The wires 40 are connected to socket 62. Socket 62 contains pins 59, which each correspond to one of the channels 51–55, except one pin corresponds to a hot line 50 in the signal bus 42. Socket 62 begins the signal bus 42. A ground wire 64 is referenced to the base 38 by way of a ground bolt 66. A wire 68 carrying power is connected to the resistor 70 and the other end of the resistor 70 becomes hot line 50. Each light module 20–24 is identical except for two features: the color of the cover plates and the unique channels 51–55 to which light bulbs 80 in the light modules 20–24 are connected. Therefore, only the module 20 will be described in detail. In FIG. 3, the module 20 is illustrated in an exploded view in order to clearly show its structure. Each module is structurally identical to the module 20 and differs only electrically in that each module is responsive to a different one of the channels 51–55. They are all connected to hot line 50 since it provides a power source for the lights of the modules. As discussed hereinafter, FIGS. 8*a*–8*e* provide a detailed understanding of the alternative wiring schemes for the modules 20–24.

Means for coupling partitions of the signal bus 42 located in the base 38 and the light module 20 are provided by plugs 74 in the module (FIG. 5) and sockets 62 in the base (FIG. 6). Contacts 63 of a light bulb socket 81 fit into indentation 65 on top plate 67 of the light module 20, thus enabling the light modules 20–24 to stack together evenly. In other embodiments, the indentation 65 may be a hole in the top plate 67.

Once plugs 74 and sockets 62 are coupled together, the signal bus 42 extends from the base 38 through light module 20. An upper portion of FIG. 5 illustrates plugs 78 of the next light module 21 being coupled to sockets 76 of the light module 20. In this manner, the signal bus 42 continues to extend through the succession of stacked light modules 20–24. This important aspect of the invention provides for the unique module to illuminate regardless of its position in the stack.

A standard color configuration for the signaling device may have five light modules colored clear, blue, red, amber and green. Each color may have a particular meaning in its application. For example, the clear light module may indicate that it is time to change a component on the machine; the blue light module may indicate that three consecutive faulty parts have been produced; the red light module may indicate that the machine has stopped due to a fault; the amber light module may indicate that the machine is waiting for parts to be loaded or taken away; and the green light module may indicate that the machine is operating in cycle. A light module may also remain in a constantly lit mode or a flash mode when activated, wherein each of these modes indicates a specific operating status of a machine or process.

FIG. 3 is an exploded view of the module 20 that more clearly shows the pins 86 of sockets 76, the plugs 74, and the plurality of channels 51–55 which make up the portion of the signal bus 42 in each module. In this embodiment it can be seen that there are three pins 86 in each of the two sockets 76 for a total of six lines 50–55.

The signal bus 42 in the illustrated embodiment includes one power line 50 and five machine-status lines 51–55. More generally, if n is the number of total lines, then up to (n−1) modules may be used in the signaling device to provide a unique response for each machine status line. Although FIG. 1 only shows three light modules 20–22 in the signaling device 14, the illustrated embodiment has five channels 51–55 that will accommodate up to five light modules in a manner such that each module is responsive to a different one of the channels. Other embodiments having a different number of channels may provide for more or less light modules that may be arranged in any order and still function properly.

Figure 8A:
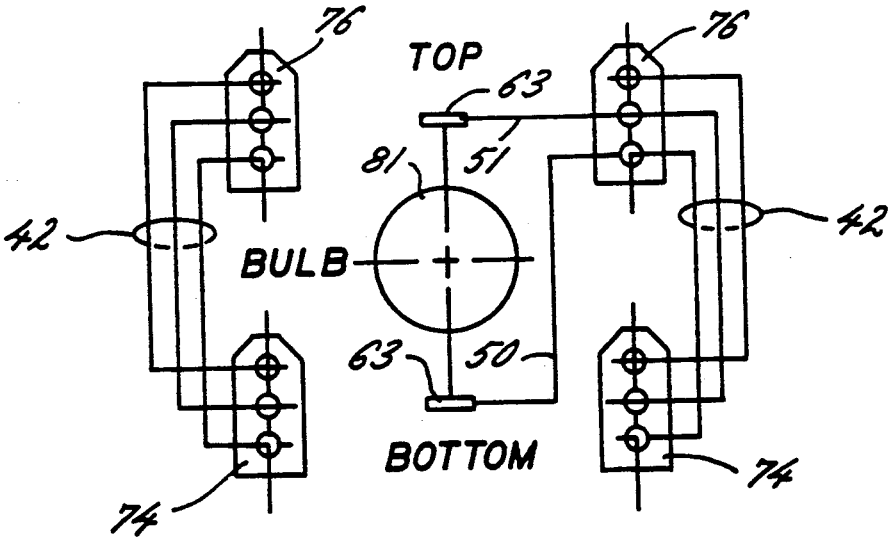
Figure 8B:
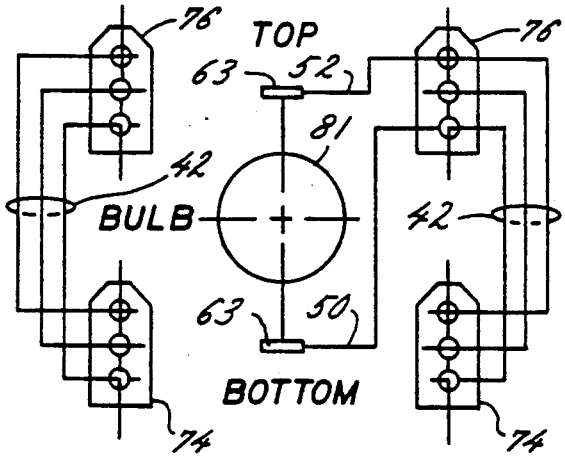
Figure 8A:
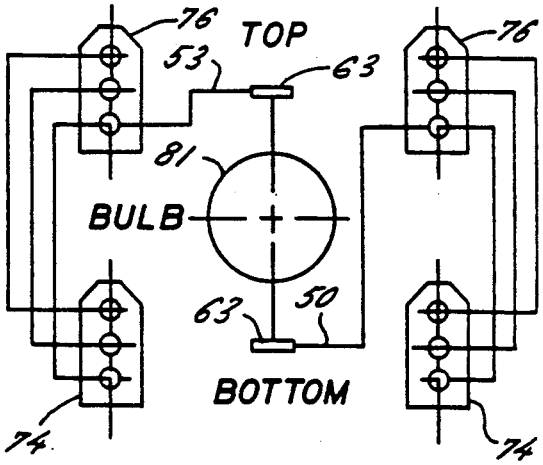
Figure 8D:
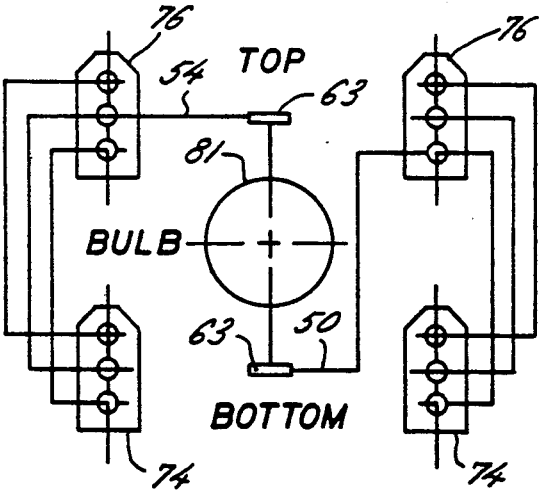
Figure 8E:
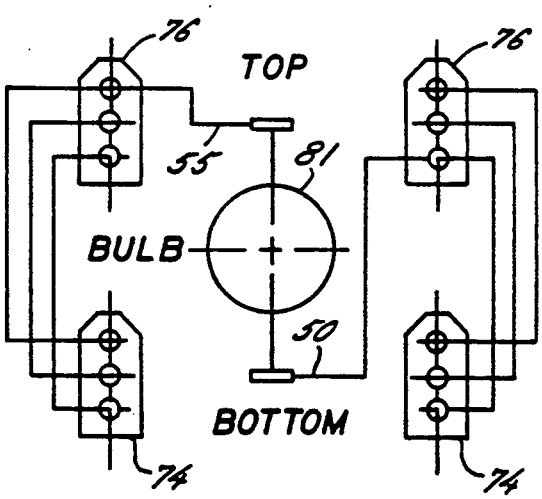

Each of FIGS. 8*a*–8*e* illustrates the light bulb socket 81 of the module 20 connected to different channels 51–55. The five alternative wiring schemes of FIGS. 8*a*–8*e* illustrate how five modules can be stacked end-to-end and provide a unique response to status signals from one of the machines 12. If each of the wiring schemes of FIGS. 8*a*–8*e* represents a different module, a stack of five modules may be assembled by joining the sockets and plugs to provide a signaling device wherein each module is uniquely responsive to one of the channels defining the machine status lines. Because of the signal bus structure of the device, the modules can be stacked in any order. For example, FIG. 8*a* illustrates how the light bulb socket 81 is only connected to channel 51, which carries a unique status signal, and the hot wire 50 is connected to the power supply input 94 via the resistor 70. Likewise, FIGS. 8*b*–8*e* illustrate a socket 81 being connected to a unique position in socket 76 for each one of the channels 52–55, respectively, while maintaining the connection to line 50.

The signal bus in the illustrated, preferred embodiment employs a plurality of individual wires that each carry a unique status signal for a specific module. In other embodiments, however, the signal bus may be one wire (plus a return wire) common to all modules. This common line, or "party line" communicates serial data words that may be digital or analog, but each data word includes an address code to identify the module for which the data word was intended. The data words instruct the modules to activate or deactivate.

In this embodiment, each module has an address recognition means (ARM), such as a microprocessor or other decoding intelligence. The ARM reads the address code of each received data word and determines if a data word is an instruction for that specific module, or if the received data word should be ignored. In this manner, all modules receive every communicated data word, but the ARM in each module determines if a module should respond to that data word.

Figure 9:
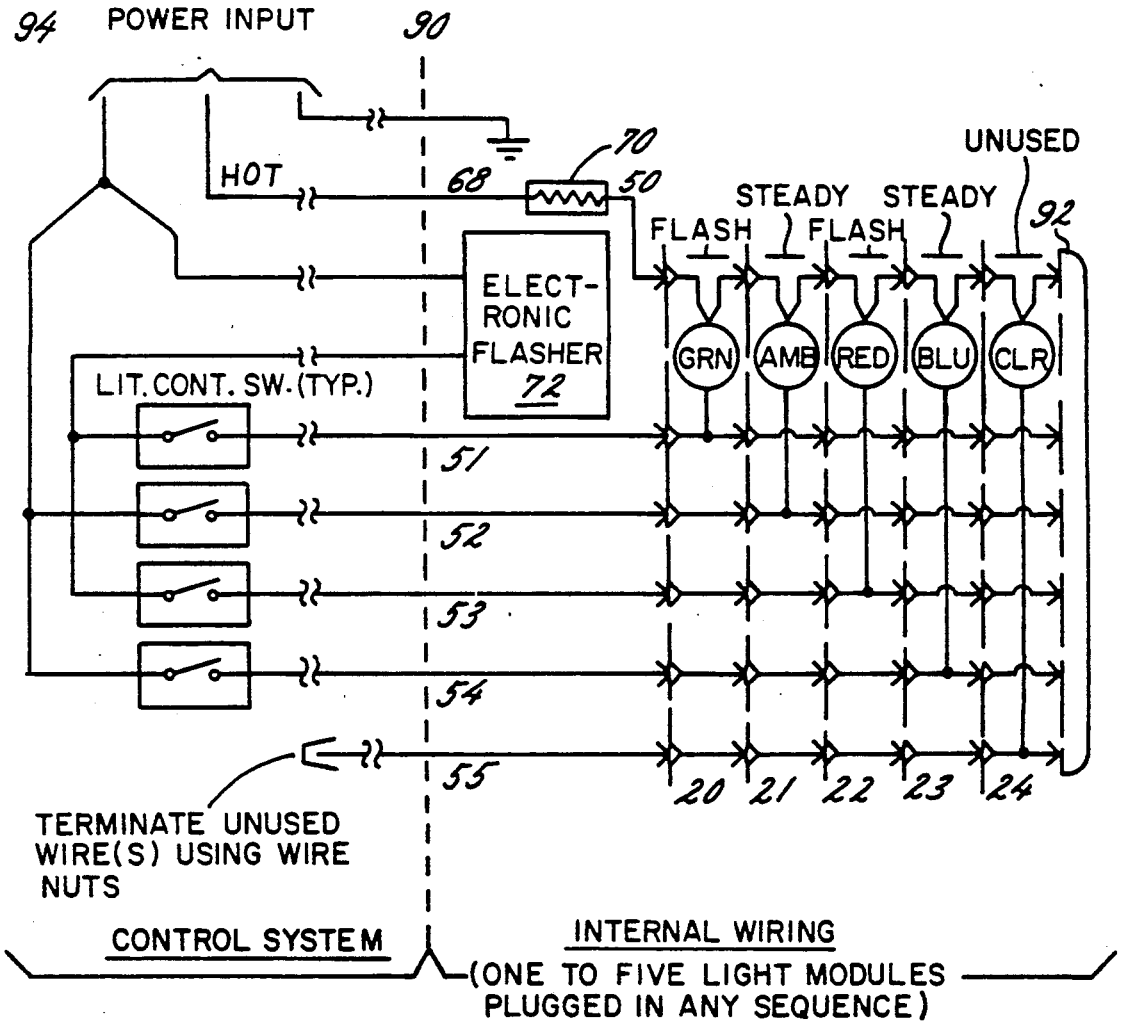
FIG. 9 is a wiring diagram of the communications bus for a signaling device of the invention that incorporates five (5) stacked light modules.

Returning to the preferred embodiment, FIG. 9 illustrates a substantially complete wiring diagram for a signal bus utilizing a plurality of individual lines. FIG. 9 exemplifies a five-module embodiment wherein two of the light modules 21, 23 are continuously lit (on steady) when activated and two of the light modules 20, 22 flash when activated. In this regard, FIG. 9 illustrates the signaling device with modules of all five possible configurations as shown in FIGS. 8*a*–8*e*. Each of the five possible configurations are embodied in one of the five modules 20–24 in FIG. 9. Because the machine 12 is providing only four (4) status signals to the signaling device 14, one of the five light modules is responsive to an unused channel (module 24) and is inoperative in the embodiment of FIG. 9.

Dotted line 90 separates internal wiring of the signaling device 14 and a control system for the signaling device 14. When the signaling device 14 is assembled, the dotted line 90 represents the wiring 40 entering a bottom of the pole 16. A cap 92, the light modules 20–24 and the lines 50–55 are illustrated in a matrix format in order to clearly show the wiring scheme of the assembled device.

As can be seen from FIG. 9, each of the light bulb sockets 81 in light modules 20–24 is wired to hot wire 50 and one of the return channels 51–55. In an alternative, channels 51–55 may be hot wires and wire 50 the return. As previously discussed, the resistor 70 serves to drop voltage from the power input 94 to each of the light modules 20–24. The resistor 70 steps the voltage down so as to increase the life of the bulbs 80 in the light modules 20–24 and to reduce frequency of maintenance.

The two light modules 20, 22 have their return channels 51, 53 connected to the electronic flasher 72 in order to cause the light modules 20, 22 to flash when activated. In contrast, light modules 21, 23 are directly connected to common return 96 to cause the light modules 21, 23 to remain constantly lit when activated. FIG. 9 also illustrates how an unused light module, here the clear light module 24, is connected in the signaling device 14.

In accordance with another important aspect of the present invention, each of the light modules 20–24 may be serviced without requiring the stacked modules to be disassembled. Referring to the illustration of the module 20 in FIG. 3, which is representative of all the modules, transverse frame supports 98 of the light module frame include pairs of posts 100, 102 for securing the cover plates 30 to the frame of the light module 20. The cover plates are made of a material capable of yielding relatively easily, such as flexible plastic, which enables the cover plates 30 to slide over the posts 100, 102 and snap into place.

Figure 4:
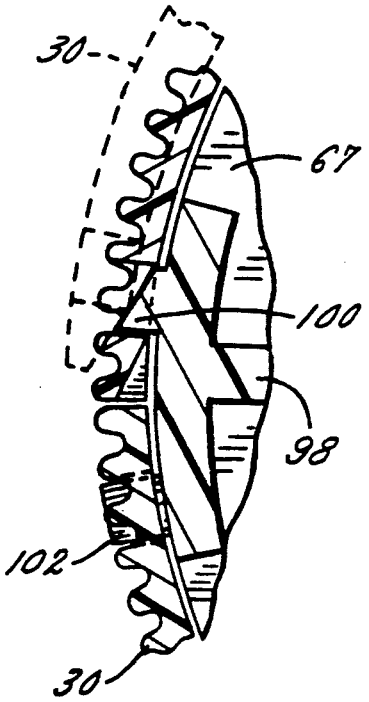
FIG. 4 is a partial, cross-sectional view of one of the light modules taken along the line 4—4 of FIG. 3 and illustrating the mechanism for securing a cover plate of the module.

In order to snap the cover plates 30 on the module 20, apertures 104 on one side of the cover plate are first placed over widely spaced posts 102 on the transverse frame support 98 of the light module 20. The cover plate 30 is then pushed over the pair of posts 100 located on the opposite transverse frame support 98 of the other side of the light module 20. To ease the cover plate 30 over the posts 100, the faces of the posts are angled to gradually stretch the cover plate as it is pushed over the posts in order to mate the posts with apertures 104. Likewise, the second cover plate 30 is attached to the light module 20 in the same fashion. FIG. 4 illustrates in phantom how the cover plate 30 yields radially as it is being attached to or removed from the transverse frame support 98 of the light module 20.

In order to remove each of the cover plates 30 from the light module 20 without requiring the entire light module 20 to be removed from its stacked configuration, a pry slot 106 is provided in one edge of the cover plate. A flat blade screwdriver is inserted into the pry slot 106 to radially expand the cover plate in the area of the pair of posts 100, sliding the cover plate off the posts and then lifting the cover plate 30 off the more widely spaced pair of posts 102. The other cover plate 30 of the module 20 is also equipped with a pry slot 106 and may be removed from the light module 20 in the same manner. After one cover plate 30 is removed, the internal components of the light module 20 are made readily accessible to a service person. The other cover plate retains the color identity of the light module during service. A service person is able to access all the internal components of a light module 20 without having to remove the light module 20 from its stacked arrangement in the signaling device 14. Furthermore, this feature enables the color of the light module 20 to be changed if desired without requiring the module to be removed from the signaling device 14. A service person simply removes the cover plates 30 and replaces them with new cover plates 30 of the desired color. Such a feature enables light modules 20–24 to be quickly and economically modified. In the preferred embodiment, the transverse frame support 98 is made of a transparent material such as clear plastic. Transparent frame supports 98 do not block light emitted from the light bulb 80, thus preventing a blind spot from being created between the light bulb 80 and a monitoring person.

In keeping with the easy serviceability of the invention, the light modules 20–24 are designed to utilize dilating rivets 108 enabling the signaling device 14 to be quickly and easily assembled or disassembled. Preferably, the dilating rivets 108 are part No. SR-5075 manufactured by Richo Corporation of Chicago, Ill. The dilating rivets 108 are designed to expand after they are inserted into mounting holes 110 Pressing down on a head of the rivet 108 causes a distal end of the dilating rivet to expand and secure the rivet 108 in the mounting hole 110.

The bottom light module 20 is attached to the base 38 by first coupling the plugs 74 of the light module 20 into the sockets 62 of the base 38, making sure that the pins 59 of the sockets 62 align correctly with the corresponding holes of the plugs 74. Once the corresponding plugs 74 and sockets 62 are connected, the light module 20 is secured to the base 38 by inserting a dilating rivet 110 into each of the mounting holes 110 and then pressing down on the head of each dilating rivet 108 in order to expand the distal ends and secure each rivet 108 in a mounting hole 110.

A second light module 21 is secured to the bottom light module 20 in the same manner as the bottom light module 20 is secured to the base 38. This sequence is repeated until all the light modules are secured to form the signaling device 14.

As previously discussed, the order the light modules 20–24 are stacked does not effect their functioning properly as long as the desired cover plates are attached to a light module of the proper channel. If not, the desired color of cover plates may be easily replaced as discussed above. Once the uppermost light module is secured, the cap 92 is secured to the top of the stack. The cap 92 functions to protect the top light module 22 and provide the signaling device !4 with a finished look. Snap rivets 109 are molded into the cap 92 for fastening the cap 92 to the mounting holes 110 in the top of the uppermost light module (see FIG. 2).

To disassemble the signaling device 14, the cover plates 30–32 are removed from the light module frames according to the previously discussed technique. To disassemble the light module frames, the dilating rivets 108 may be disassembled by first gently prying up the head of each rivet 108 with a flat blade screwdriver in order to contract the distal ends, and then removing each rivet 110 from the mounting holes 110. The cap 92 also can be removed by gently prying up the snap rivets 109. The base 38 may be serviced by unscrewing the four flat head screws 112 that secure the base top 114 to the base 38.

In order to record automatically the changing status of each machine 12 as indicated by each signaling device 14, a separate data logger 18 may be provided for each signaling device 14. The data logger 18 automatically records on/off time of each of the light modules 20–24 (FIG. 9) and activation time of each module. In this manner, a person is not required to waste his or her time by manually recording activity of the signaling device 14 and hence machine or process time.

In one embodiment, data logger 18 prints out an activity record of its corresponding signaling device 14 and the service person simply collects the printouts from each data logger !8 at the end of each day. The data loggers 18 enable accurate records to be made of signaling device activity while allowing service persons to make more efficient use of their time.

I claim as my invention:

1. A signaling device comprising:

a plurality of modules, each module having first and second opposing ends and the plurality of modules configured in an arrangement forming a stack of modules;

a light assembly contained in each of the modules;

a signal bus extending through all of the modules in the stack for carrying status signals to the light assemblies;

wiring within each module for communicating a status signal from the signal bus to the light assembly; and an interface between each adjacent pair of the modules for maintaining electrical continuity of the signal bus throughout the stack and also maintaining the proper interlinking of each portion of the signal bus within each module such that the modules can be stacked in any order without affecting the response of the light assembly in each module to a status signal from the signal bus.

2. The signaling device as defined in claim 1, wherein the signal bus is a serial transmission line common to each module, and each module further comprising:

address recognition means for determining a distinct status signal of the module via an address code included within each status signal.

3. A signaling device having a plurality of modules responsive to a device for detecting operating status of a machine or process, said signaling device comprising:

a plurality of modules, each module having first and second opposing ends and the plurality of modules configured in an arrangement forming a stack of modules;

a light assembly contained in each of the modules;

a signal bus extending through all of the modules in the stack comprising a plurality of signal channels for carrying status signals to the light assemblies indicative of an operating status of a machine or process;

wiring within each module responsive to the signals of at least one of the channels for providing power to the light assembly; and an interface between each adjacent pair of the stack of modules for maintaining electrical continuity of the signal bus throughout the stack and also maintaining the relative positions of the plurality of channels with respect to one another such that the modules can be stacked in any order without affecting the response of the light assembly of each module to a signal of at least one channel.

4. The signaling device as defined in claim 3, further comprising:

a base member for supporting the stack of light modules and coupling the status signals from the device to the signal bus.

5. The signaling device as defined in claim 3, wherein each light module includes an inner framework supporting the light assembly and positioning the first and second opposing ends in a spaced relationship by at least one transverse frame support.

6. The signaling device as defined in claim 5, wherein the transverse frame support is transparent in order to eliminate any visible obstruction between an observer and light emanating from the light assembly within the module.

7. The signaling device as defined in claim 3, wherein the light assembly houses an incandescent light bulb.

8. The signaling device as defined in claim 3, wherein the number of channels in the signal bus is n and number of light modules in the signaling device required for the wiring in each module to function independently of other modules is less than n, wherein at least one channel is connected to all the modules and each of the remaining channels is connected to the light assembly as only one module.

9. The signaling device as defined in claim 5, comprising:

a transparent cover plate assembly for mounting to the inner framework, thereby protecting the interior of each module and causing each module to emit a distinguishing color when activated; and means for allowing the cover plate assembly to be released from the inner framework without material of either the cover plate or the inner framework yielding beyond its elastic limit.

10. The signaling device as defined in claim 9, wherein the cover plate assembly includes:

means for dispersing light waves produced by a light source within the light module.

11. The signaling device as defined in claim 10, wherein the dispersing means include fluted lens.

12. The signaling device as defined in claim 9, wherein the cover plate assembly includes:

an annular lens assembly for mounting to the inner framework where the assembly comprises at least two sections;

a snap-fitting arrangement enabling at least one of the two sections of the annular lens assembly to be mounted to the inner framework; and means for allowing at least one of the two sections to be released from its snap-fitting with the inner framework without the material of either the section or the inner framework yielding beyond its elastic limit.

13. The signaling device as defined in claim 12, the annular lens assembly having apertures and the transverse frame support having posts which fit into the apertures, wherein the annular lens assembly is secured to the transverse frame support by inserting the posts into the apertures, and the annular lens assembly may be removed from the module by raising the apertures off the posts.

14. The signaling device as defined in claim 4, said base member further comprising:

flashing means electrically connected between the detecting device and the signal bus, thereby enabling a light source within a module to flash instead of remaining constantly lit when the module is activated.

15. The signaling device as defined in claim 3, wherein the interface includes a plug-socket arrangement, each channel being situated at a substantially identical location on each plug and socket, and the plug-socket arrangement allowing the plurality of modules only to be assembled in a manner that positions each channel at a substantially identical location on each plug and socket.

16. The signaling device as defined in claim 3, said signaling device further comprising:

a cap to be secured to an unconnected end of a module which is opposite an end connected to another module, wherein the module securing the cap is the farthest module from the base member in relation to the plurality of modules.

17. The signaling device as defined in claim 3, said signaling device further comprising:

a data logger for automatically recording operating statuses as indicated by the signaling device.

18. The signaling device as defined in claim 3, wherein the modules are secured together by dilating rivets.

19. The signaling device as defined in claim 3, wherein the light assembly houses a strobe light.

20. A signaling device having a plurality of modules responsive to a device for detecting operating status of a machine or process, said signaling device comprising:

a plurality of modules, each module having first and second opposing ends and the plurality of modules configured in an arrangement forming a stack of modules;

a light assembly contained in each of the modules;

a stack of modules to be mounted above the machine or process in order to enhance visibility of the signaling device to a monitoring person;

a signal bus having signal lines 1 through n extending through all of the modules in the stack for carrying status signals to the light assemblies, such that each of the n lines is dedicated to one of the modules regardless of the position of the one module in the stack; and a data logger for automatically recording operating status as indicated by each module of the signaling device.

21. The signaling device as defined in claim 20, wherein the data logger records a time when each light module is activated or deactivated.

22. A signaling device having a plurality of modules responsive to a device for detecting operating status of a machine or process, said signaling device comprising:

a plurality of modules, each having first and second opposing ends and the plurality of modules configured in an arrangement forming a stack of modules;

a light assembly contained in each of the modules;

wiring extending through all of the modules in the stack for carrying status signals to the light assemblies indicative of an operating status of the machine or process;

an interface between each adjacent pair of the modules int he stack for maintaining electrical continuity of the wiring through out the stack;

each module including an inner framework supporting the light assembly and positioning the first and second ends in a spaced relationship by way of at least one transverse frame support;

a transparent cover plate assembly mounted to the inner framework for protecting the light assembly and wiring and for providing a lens for the light assembly; and a portion of the cover plate assembly having means for allowing the portion to be snap-fitted onto the inner framework such that neither the portion or the inner framework yields beyond its elastic limit.

23. The signaling device as define in claim 22, wherein the portion of the cover plate assembly that is snap-fitted to the inner framework includes an annular lens which includes apertures that mate with posts associated with the transverse frame in order to secure the annular lens to the transverse frame support in a snap-fit arrangement.

24. The signaling device as defined in claim 22, wherein the interface includes a plug-socket arrangement for maintaining the continuity of the wiring throughout the stack of modules while also allowing the modules to be easily removed from or repositioned in the stack.

* * * * *